United States Patent [19]

Tanaka et al.

[11] Patent Number: 4,916,490

[45] Date of Patent: Apr. 10, 1990

[54] IMAGE FORMING APPARATUS COMPRISING A PLURALITY OF DEVELOPING DEVICES

[75] Inventors: Hidetoshi Tanaka; Yoshikuni Tohyama, both of Yokohama, Japan

[73] Assignee: Canon Kabushiki Kaisha, Tokyo, Japan

[21] Appl. No.: 294,641

[22] Filed: Jan. 9, 1989

Related U.S. Application Data

[63] Continuation of Ser. No. 802,537, Nov. 27, 1985, abandoned.

[30] Foreign Application Priority Data

| | | | |
|---|---|---|---|
| Dec. 1, 1984 | [JP] | Japan | 59-254723 |
| Dec. 8, 1984 | [JP] | Japan | 59-259814 |
| Mar. 4, 1985 | [JP] | Japan | 60-042390 |

[51] Int. Cl.[4] ..... G03G 15/08

[52] U.S. Cl. ..... 355/245; 355/260

[58] Field of Search ..... 355/3 R, 3 DD, 14 D, 355/4, 245, 260; 222/DIG. 1

[56] References Cited

U.S. PATENT DOCUMENTS

| | | | |
|---|---|---|---|
| 3,960,445 | 6/1976 | Drawe | 355/4 |
| 4,523,834 | 6/1985 | Pelda et al. | 355/14 D Y |
| 4,607,939 | 8/1986 | Saito | 355/3 DD |
| 4,619,514 | 10/1986 | Ide | 355/140 Y |

FOREIGN PATENT DOCUMENTS 59101260 12/1982 Japan .

*Primary Examiner*—Joan H. Pendegrass

*Attorney, Agent, or Firm*—Fitzpatrick, Cella, Harper & Scinto

[57] ABSTRACT

An image forming apparatus including at least first and second developing devices for developing latent images formed on an image bearing member. The first and second developing devices contain developers of different colors, respectively. The second developing device contains a developer of a predetermined color and is fixedly mounted in the image forming apparatus. The first developing device contains a developer of a color other than the predetermined color and is detachably mountable in the image forming apparatus. Only the first developing device is exchangeable.

22 Claims, 8 Drawing Sheets

IMAGE FORMING APPARATUS COMPRISING A PLURALITY OF DEVELOPING DEVICES

This application is a continuation of application Ser. No. 802,537 filed Nov. 27, 1985, now abandoned.

FIELD OF THE INVENTION AND RELATED ART

The present invention relates to an image forming apparatus, more particularly to an image forming apparatus provided with plural developing devices which contain developers of different colors. The image forming apparatus to which the present invention is directed includes a color copying apparatus, a color printer constituting an output station of a computer, a facsimile machine or the like, and other various color recording devices.

Recently, there is an increasing demand for a color image not only in a specific field but also in the field of ordinary office work. Therefore, a color image forming apparatus is desired which can be used by non-experts as well as by experts. In some cases, it is required that a multiple color original in two, three or more colors (non-pictorial) or a full-color (pictorial) original is copied or recorded in a desired color. To meet this demand, it is desired to provide an apparatus wherein the copying or recording can be efficiently effected selectively with two, three or more colors in a full-color image forming apparatus as well as in a multiple color image forming apparatus. With the view to this, a conventional color image forming apparatus is equipped with a plurality of developing devices which contain different color developers. For example, the image forming apparatus includes two developing devices to form an image in two colors, wherein one of the developing devices is for a black color which is most frequently used, and the other is for non-black color, such as red, blue or green. Those developing devices are easily replaceable with another or fresh one. This causes a problem. For example, an operator might replace the black color developing device with the developing device for another color and then take a copy, whereafter he might leave as it is. If the next operator wants to take a copy in the black color, he must look for the black color developing device. If the second operator takes a copy without noticing that the black color developing device is not set in the machine, the machine produces the image in a non-black color against his intention, which is very inconvenient. Since the black color developing device is most frequently used, the above-described situation can occur frequently and impose an unnecessary load on the operators.

SUMMARY OF THE INVENTION

Accordingly, it is a principal object of the present invention to provide an image forming apparatus which is substantially free from the above-described problem so that the developing device of a predetermined color which is frequently used can be used at all times, while the developing devices of the other colors can be selectively used.

It is another object of the present invention to provide an image forming apparatus which is improved in the operativeness.

It is a further object of the present invention to provide an image forming apparatus wherein the space in the image forming apparatus occupied by the developing device is efficiently utilized so as not to require the operator to frequently supply the developer to the developing device which is more frequently used.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 6 and 7 is a sectional view of an example of a developing device containing chamber of the copying apparatus, wherein FIG. 6 shows the state in which the developing device is not accommodated in the chamber, and FIG. 7 shows the state in which the developing device is set in place therein.

DETAILED DESCRIPTION OF THE PREFERRED EMBODIMENTS

Figure 1:
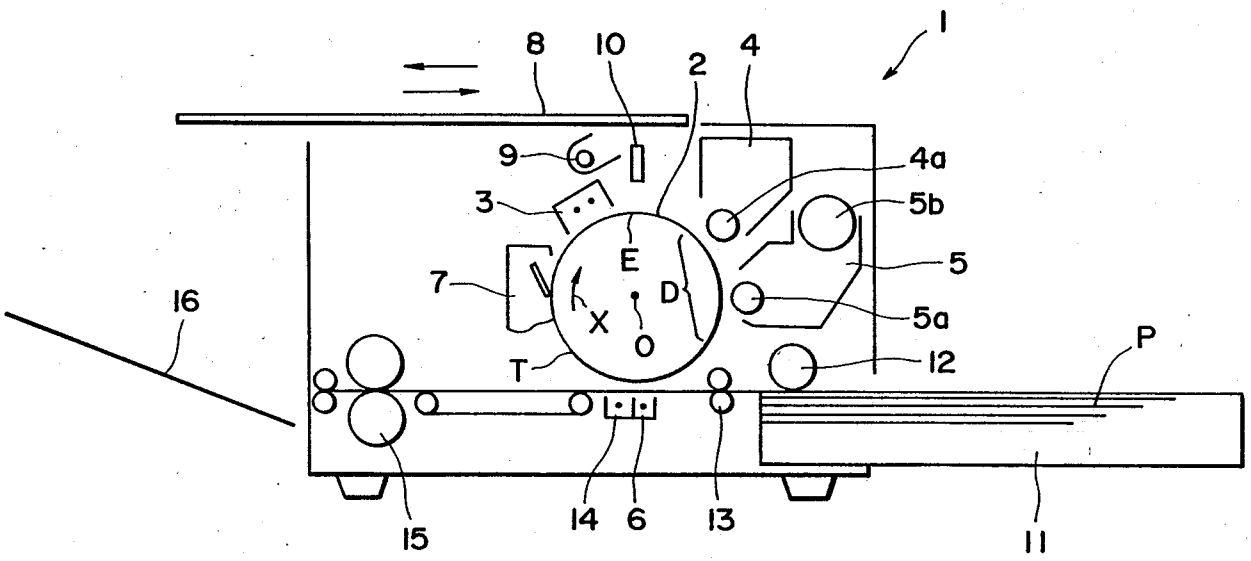
FIG. 1 is a sectional view of an electrophotographic copying apparatus according to an embodiment of the present invention.

Referring to FIG. 1, there is shown an electrophotographic copying apparatus which is an exemplary image forming apparatus according to the present invention. The illustrated copying apparatus is of a movable original carriage type wherein the original carriage for supporting an original to be copied is reciprocated to optically scan the original. The latent image forming process may be of any type, but for the purpose of explanation, the illustrated copying apparatus is based on Carlson process.

The copying apparatus 1 has substantially in the middle thereof a cylindrical photosensitive member, that is, a photosensitive drum 2 in this embodiment, including a surface electrophotographic photosensitive layer. The photosensitive member may be in the form of a belt. The photosensitive drum 2 is rotatably and detachably mounted on an unshown shaft which is co-axial with the rotational center O of the photosensitive drum 2 in a known manner. In this embodiment, the photosensitive drum 2 rotates in the direction indicated by an arrow X, that is, in the clockwise direction as seen in FIG. 1.

Around the surface of the photosensitive drum 2, there are a primary charger 3 substantially right above the photosensitive drum 2, developing devices 4 and 5 at the righthand side of FIG. 1, a transfer charger 6 substantially right below the photosensitive drum 2 and a cleaning device 7 at the lefthand side as seen in FIG. 1.

The original carriage 8 which is reciprocable in the direction of the arrow is disposed at the upper portion of the copying apparatus. An unshown original to be copied placed on the original carriage 8 is illuminated by an illumination light source 9. An image of the original thus illuminated is projected onto the surface of the photosensitive drum through an optical system 10 at an image exposure station E disposed between the primary charger 3 and the developing device 4. The optical system 10 may be of any type, but in this embodiment employs as an example an array or arrays of small diameter imaging elements such as "Selfoc" (tradename), available from Nippon Itagarasu Kabushiki Kaisha, Japan.

In operation, the photosensitive drum 2 starts to rotate in the directon of the arrow X with the start of the copying operation and is electrically charged by the primary charger 3. The thus charged part of the photosensitive drum 2 reaches the image exposure station E and is exposed through a slit to a flowing image of the original on the original carriage 8 by the illumination source 9 and the optical system 10, so that an electrostatic latent image is formed on the photosensitive drum 2. The latent image formed on the photosensitive drum 2 reaches by the continuing rotation of the photosensitive drum 2 a developing station D having a first developing device 4 and a second developing device 5, wherein the electrostatic latent image is developed into a visualized toner image by a selected one of the developing devices 4 and 5.

Each of the developing devices 4 and 5 includes a developing roller 4*a* or 5*a*. Those developing devices contain the developers of different colors. As for the developing process or system, those disclosed in Japanese Patent Application 92108/1978, for example, may be used. The developer may be a one component developer consisting of toning material or may be two component developer comprising toning material and carrier material.

The toner image on the photosensitive drum 2 is conveyed to a transfer station T having the transfer charger 6, where the toner image is transferred onto a transfer material P which has been fed out of the paper supplying device 11 by a pick-up roller 12 and is fed to the photosensitive drum 2 by timing rollers 13 in timed relation with the toner image so as to be aligned with the toner image. The transfer material P now having the toner image is separated from the photosensitive drum 2 by a separation charger 14 and is conveyed to an image fixing device 15, where the toner image is fixed on the transfer material P. Then, the transfer material is discharged to a tray 16.

On the other hand, the photosensitive drum 2 after the image transfer is cleaned by the cleaning device 7 so that the toner remaining on the surface of the photosensitive drum 2 is removed so as to be prepared for the next image forming process.

The developing devices 4 and 5 will be described in further detail. As mentioned above, the developing devices 4 and 5 are disposed, at a side of the photosensitive drum 2, one above the other along the photosensitive drum 2.

In this embodiment, the lower developing device 5 contains a relatively more frequently used developer, for example, a black toner, and is relatively large in size equipped with toner supplying device 5*b*. The lower developing device 5 is fixedly mounted in the copying apparatus. The upper developing device 4, on the other hand, is a developing device containing a less frequently used developer for example, a non-black developer such as red, blue, green or yellow. The upper developing device is disposed adjacent the top part of the apparatus. The upper developing device 4 is capable of being detached from the copying apparatus through an upper portion thereof, as will be described in detail hereinafter. Since the original carriage 8 is reciprocable on the top of the apparatus in this embodiment, the original carriage 8 is moved to the left position as shown in FIG. 1 so as to allow access to the developing device 4 when the developing device 4 is to be taken out.

Figure 2:
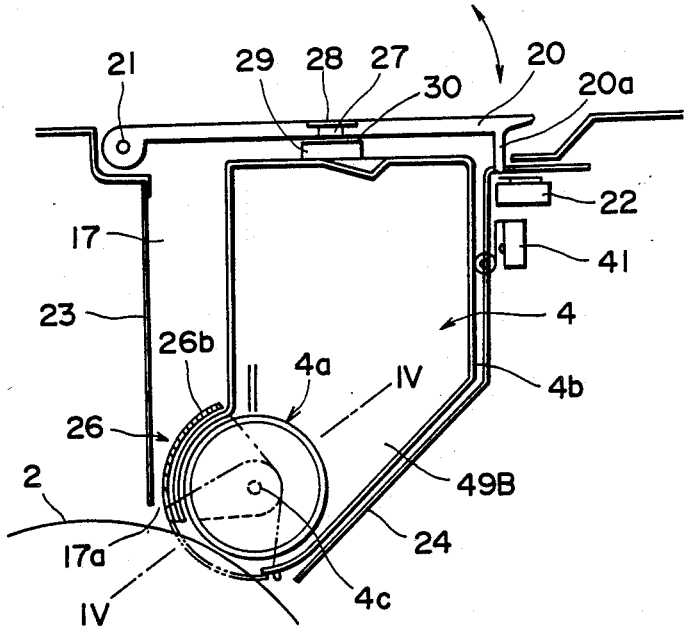
FIG. 2 is an enlarged sectional view of a part of the developing device used in the copying apparatus of FIG. 1.

Referring to FIG. 2, means are shown for allowing mounting and demounting of the developing device 4 with respect to the copying apparatus. The developing device 4 can be detachably accommodated in a developing device accommodating chamber 17 defined by walls 23 and 24 and having a top opening. The chamber 17 is located at an upper portion of the apparatus. Adjacent the top opening, there is a cover 20 pivotable about a shaft 21, which cover can close the developing device accommodating chamber 17. Because of this structure, if the toner were scattered out of the developing device 4, the toner would not contaminate the other part of the apparatus. The walls 23 and 24 are effective to protect operator's hands from damage by contacting parts of the apparatus when the developing device 4 is exchanged. The free end of the cover 20 is provided with a projection 20*a* which is electrically connectable to detecting means 22, which detects the opening and closing of the cover 20, whereby the original carriage 8 is controlled so as not to move when the cover 20 is opened. The cover 20 is further provided with a window 27 which is closed by a transparent member 28. Correspondingly, on the top of the developer container 4*b* of the developing device 4, there is provided a grip 29 at such a position as to be opposed to the window 27, and the top side 30 of the grip 29 has a color the same as that of the tone contained in the developing device. Therefore, the operator can visually confirm the kind (color) of the developing device 4 currently mounted in the apparatus, through the window 27 without necessity of opening the cover 20.

As for means for detecting the color of the developing device mounted in the copying machine, various kinds of means can be employed other than the above-described visual means. For example, identification codes may be provided for each of the developing devices, and code reading means provided in the chamber 17 may read the code so as to identify the currently set developing device. As another alternative, the color of the developer may be directly observed.

Further, the developing device accommodating chamber 17 is equipped with means 41 for detecting the absence or presence of the developing device and a microswitch actuable by the container 4*b* of the developing device 4 in this embodiment, which means are effective to display the absence or presence of the developing device, or to produce a warning in the case of erroneous operation.

Figure 3:
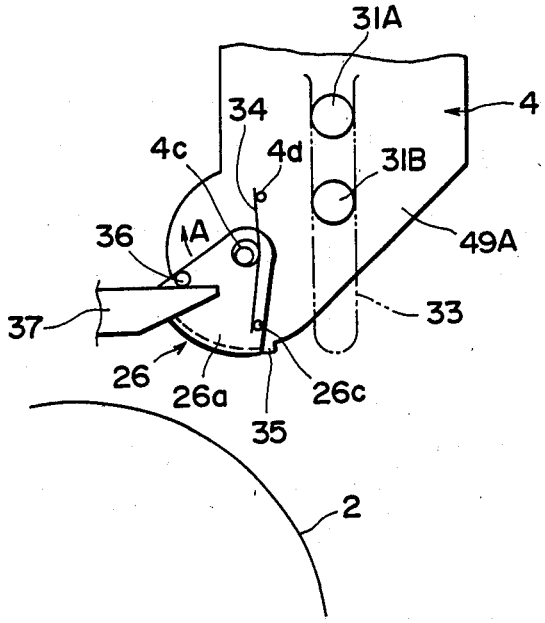
FIG. 3 is a side view of a part of the developing device, showing a detachable developing device is inserted part-way into the copying apparatus.

Referring to FIGS. 2 and 3, there are shown a developing roller cover 26, the operating mechanism therefor and guide means 31 and 33 for guiding the developing device 4 when it is mounted or demounted.

Pins 31A and 31B are fixed on a wall 49A of the developing device 4, and they are engageable with a guiding slot 33 of the apparatus extending substantially vertically so that the developing device 4 is correctly guided and is located in place in the chamber 17. Since in this embodiment the developing device 4 is mounted or demounted through an upper portion of the copying apparatus, the developing device is moved substantially perpendicularly to the photosensitive drum 2, with the result of very much decreased possibility of damaging the photosensitive drum 2. The developing device 4 has a cover 26 for covering, when it is mounted or demounted, an opening for exposing the developing roller 4*a* for the developing action, so as to protect the developing roller 4*a*. The cover 26 is provided with an arm 26*a* swingable about a shaft 4*c* which is coaxial with the rotational axis of the developing roller 4*a* and an arcuated covering plate 26*b* connected to the free end of the arm 26*a* and extending to cover the entirety of the opening. The rotational shaft 4*c* is engaged by a spring 34 having an end engaged to a pin 4*a* planted in a wall 49A of the developer container 4*b* and another end engaged to a pin 26*c* planted in the arm 26*a* so that the cover 26 is normally urged to a closing position wherein it covers the opening to prevent the developing roller 4*a* from exposure. The movement of the cover 26 is limited by a stopper 35 in the developer container 4*b*.

In this arrangement, when the developing device 4 is to be mounted into the copying apparatus, a projection 36 provided in the cover arm 26*a* is engaged to a member 37 fixed in the image forming apparatus, and therefore, the cover 26 rotates in the direction of an arrow A together with the lowering movement of the developing device 4. Thus, the developing roller 4*a* is directly opposed or contacted, if necessary, to the surface of the photosensitive drum 2. When the developing device 4 is lifted, the cover 26 moves back to the closing position by the opposite movement so as to protect the developing roller 4*a* from inadvertently abutting or touching the members therearound or from contact by the operator.

Figure 4:
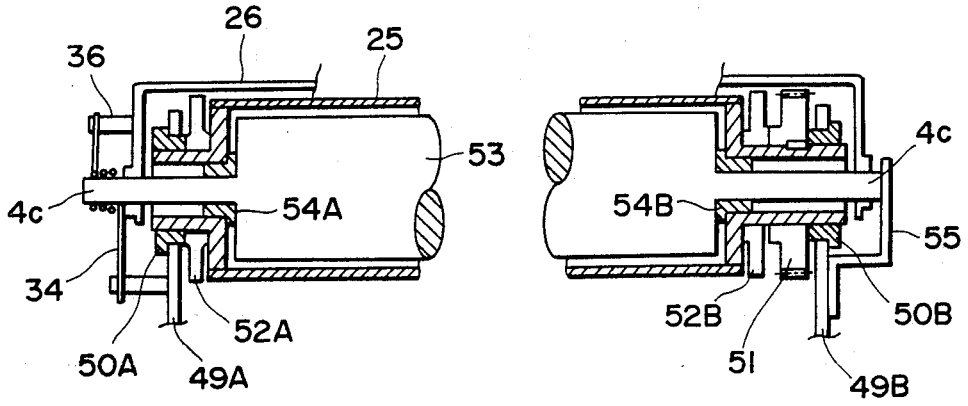
FIG. 4 is a sectional view taken along a line IV—IV of FIG. 2.

FIG. 4 illustrates the mounting of the protection cover 26 and the structure of the developing roller 4*a*. The developing roller 4*a* comprises a developing sleeve 25 and a magnet which is supported within the sleeve 25 by the bearings 54A and 54B. The developing sleeve 25 is rotatably supported on the walls 49A and 49B of the developer container 4*b* by bearings 50A and 50B. The developing sleeve 25 receives a rotational force through a gear 51 fixedly mounted to the sleeve 25. The magnet 53 is fixed in place by a fixing member 55 so that the correct position of the magnet is maintained.

After the developing device 4 is mounted in the copying apparatus, it may be maintained at a fixed position. In this case, the gear 51 is meshed with a driving gear (not shown) of the copying apparatus. On the contrary, it may be movable between a developing position and a non-developing position with respect to the photosensitive drum 2 after the developing device 4 is mounted in the copying apparatus. In this case, the gear 51 is selectively engageable with a gear which is rotatable integrally with the photosensitive drum 2. As another example, the developing device 4 is provided with a driving source so that the rotation of the developing sleeve 25 is controlled.

Adjacent opposite ends of the developing sleeve 25, spacer rolls 52A and 52B are provided in order to maintain a constant clearance between the surface of the photosensitve drum 2 and the surface of the developing sleeve 25. Therefore, when the developing device 4 is inserted substantially vertically along the guiding slot 33, the spacer rolls 52A and 52B are contacted to the surface of the photosensitive drum 2, thus setting the developing device 4 in place. Although the cover 26 in this embodiment is rotatably supported on a shaft 4*c* which is coaxial with the shaft of the magnet 53, it is possible to dispose the rotational axis of the cover 26 at another location as desired. However, it is preferable that the cover 26 is opened and closed in interrelation with mounting and demounting of the developing device 4.

Figure 5:
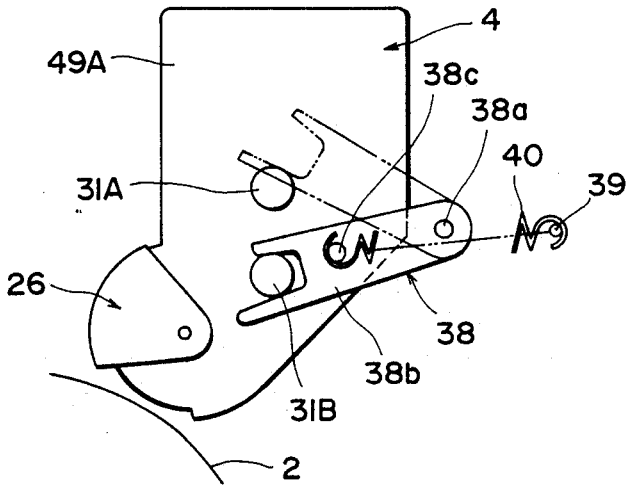
FIG. 5 is a side view of the developing device, illustrating a mechanism for holding the developing device in place.

Referring now to FIG. 5, holding means will be described which is for setting and holding the developing device 4 at a predetermined position with respect to the photosensitive drum 2 after it is inserted into the chamber 17.

The holding means includes a lever 38 having an end which is rotatably supported on a pin 38*a* planted in the copying apparatus and having a forked other end. The lever 38 has a pin 38*c*. A tension spring 40 is stretched between the pin 38*c* and a pin 39 planted in the copying apparatus. The spring 40 is effective to selectively maintain the lever 38 at the solid line position or the chain line position in FIG. 5.

When the developing device 4 is going to be inserted into the copying apparatus, the lever 38 takes the chain line position, and the lowering movement of the developing device 4 engages the pin 31B with the forked portion of the lever 38, and the lever 38 is moved downwardly.

When the developing device 4 is set in place, the lever 38 takes the position indicated by the solid lines in FIG. 5, whereby the developing device 4 is held in the place while being urged downwardly by the force of the spring 40. When the developing device 4 is taken out of the apparatus, is pivoted by the pin 31B to the chain line position together with the upward movement of the developing device 4 the lever 38, and the pin 31B is disengaged from the forked portion of the lever 38. The lever 38 is then maintained at the chain line position by the spring 40.

It is possible to employ a solenoid or the like for selectively urging the developing device 4, when the copying apparatus is such that the developing device 4 is away from the photosensitive drum 2 when it is not in operation, and only when the developing device 4 is selected, it is disposed close to the photosensitive drum 2.

Also, in the case where the developing device 4 has means for detecting the amount of developer therein and requires an electrical connection with the copying apparatus, a connector which is automatically connected by the insertion of the developing device may be provided.

The other developing device 5 is not easily demounted from the copying apparatus by an ordinary operator. Rather, it is demounted by unscrewing when the apparatus is disassembled or serviced for maintenance. Thus, the developing device 5 is fixedly mounted in the copying apparatus, the copying apparatus is operable even when the developing device 4 is not mounted in the copying apparatus. When the color of the replaceable developing device is selected in the case that the developing device 4 is not mounted in the apparatus, a display or warning may be produced to notice the operator of the inoperativeness.

In the foreging example since the developing device 4 is replaceable through an opening provided on the top of the copying machine, it is possible that foreign matter falls into the vacant developing device accommodating chamber 17 and reaches the surface of the photosensitive member through the opening 17*a* (FIG. 2) of the chamber 17 with the result of damaging the photosensitive drum 2. Therefore, it is preferable to avoid such a trouble beforehand.

Figure 7:
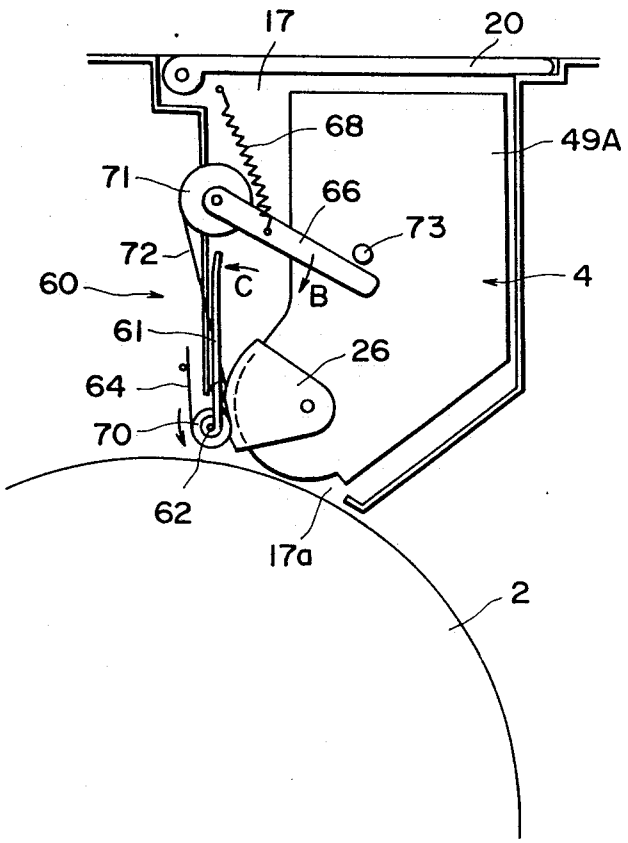
Figure 6:
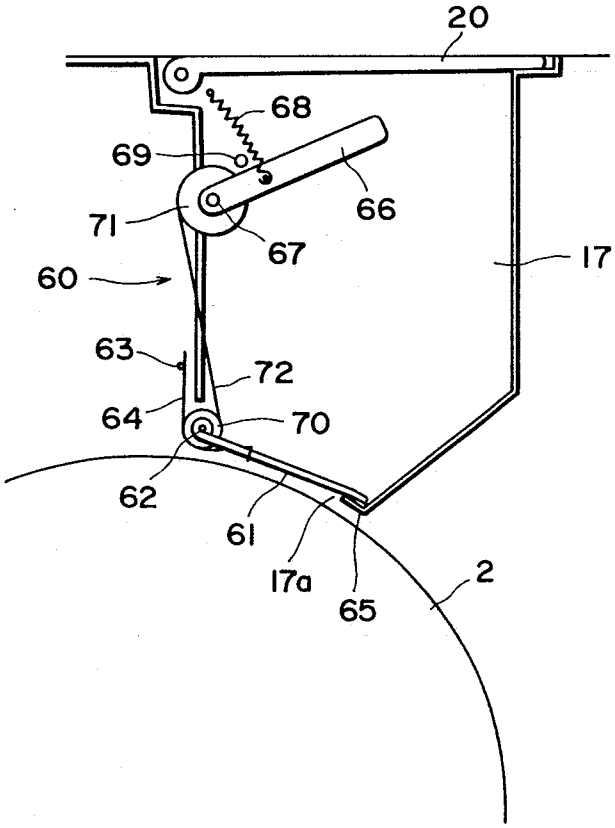

FIGS. 6 and 7 illustrate means 60 for closing the opening 17*a* of the chamber 17 to avoid this problem. The closure means 60 includes, as shown in FIG. 6, a closing plate 61 for closing the opening 17*a* of the chamber 17 when the developing device 4 is not accommodated in the chamber 17. The closing plate 61 is pivotable about the pin 62. A spring 64 is stretched between the closing plate 61 and a pin 63 planted in the copying apparatus so that the closing plate 61 is normally urged to a position wherein it closes the opening 17*a*. The leading edge of the closing plate 61 is engaged with an edge wall 65 of the chamber 17 for defining the opening 17*a* to stop movement of the closing plate 61.

The closing means 60 further includes an operating lever 66 above the closing plate 61. The operating lever 66 is pivotable about the shaft 67 and is urged counterclockwisely by a tension spring stretched between the lever 66 and the copying apparatus. The movement of the lever 66 in the counterclockwise direction is stopped by the stopper 69 planted in the copying apparatus.

Further, the closing plate 61 and the operating lever 66 are provided with pulleys 70 and 71 respectively, which are rotatably mounted on the shafts 62 and 67, respectively. Around the pulleys 70 and 71, a wire 72 are trained so as to move them interrelatedly.

With this structure, after the developing device 4 is removed from the copying apparatus, the opening 17*a* of the chamber 17 is always closed by the closing plate 61, whereby even if the foreign matter enters the chamber 17 when the cover 20 is opened, it does not reach the surface of the photosensitive member.

When the cover 20 is opened, and the developing device 4 is inserted into the copying apparatus, a projection 73 on the wall 49A of the developing device 4 engages to the operating lever 66 to rotate the lever 66 against the spring 68 in the direction of an arrow B, that is, in the clockwise direction together with the downward movement of the developing device 4. When the lever 66 rotates, the pulley 71 rotates so that the wire 72 is trained around the pulley 71. Since the wire 72 is trained around the pulley 00, the pulley 70 rotates about the shaft counterclockwisely so that the closing plate 61 rotates in the direction of an arrow C, that is, counterclockwisely against the spring 64 so as to open the opening 17*a*. Through the opening 17*a*, the developing roller 4*a* is disclosed with the protection cover 26 being removed in the manner described above.

When, on the other hand, the developing device 4 is lifted in order to remove it from the copying apparatus, the lever 66 is released from the projection 73, and therefore, the operating lever 66 and the closing plate 61 are restored to the position shown in FIG. 6 by the spring forces of the springs 68 and 64.

Figure 8:
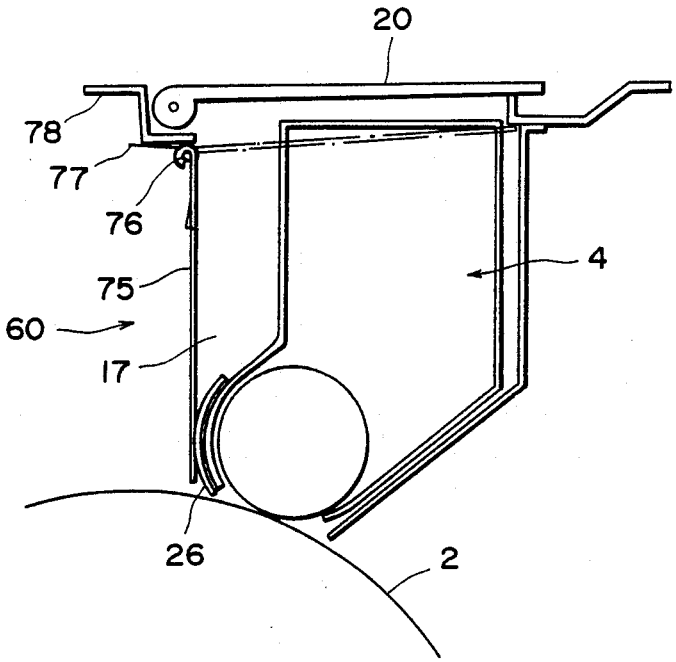
FIG. 8 is a sectional view illustrating another example of the developing device accommodating chamber.

FIG. 8 shows another example of the closing means 60. In this example, the closing means 60 is constituted by mounting for rotation about a shaft 76 one of the wall portions 75 defining the developing device accommodating chamber 17. The wall plate 75 is urged counterclockwisely in FIG. 8 by a spring 77 stretched between a top cover 78 of the copying apparatus and the wall plate 75. When the developing device 4 is not mounted in the copying apparatus, it completely closes the top opening of the chamber 12 as shown by chain lines in FIG. 8.

When, on the other hand, the developing device 4 is mounted in the copying apparatus, the bottom part of the developing device 4, more particularly, the developing roller protecting cover 26, for example, is engaged to the wall plate 75 so as to rotate the wall plate 75 against the spring 77 in the clockwise direction until the position shown by the solid lines is reached. When the developing device 4 is removed from the copying apparatus, the wall plate 75 automatically rotates by the spring 77 counterclockwisely to restore to the chain line position.

The foregoing embodiments have been described as being of a movable original carriage type, but it is apparent that the present invention is applicable to the apparatus wherein the original carriage is fixed.

Figure 9:
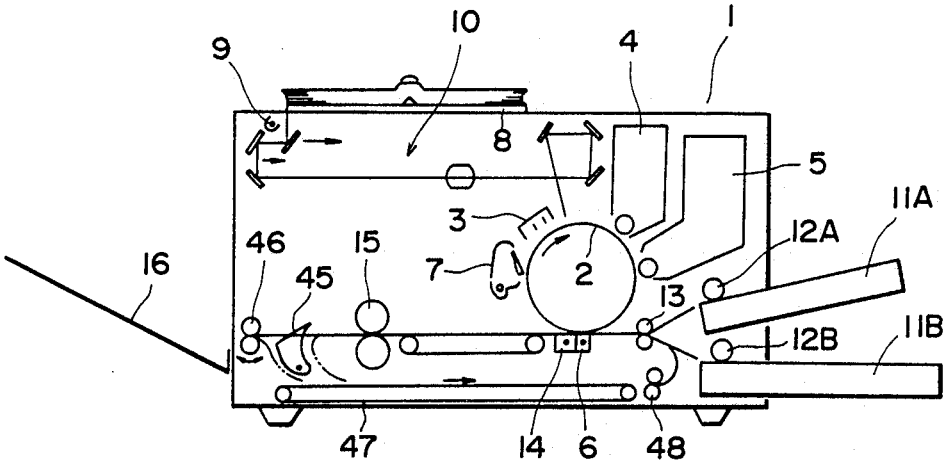
FIG. 9 is a sectional view of an electrophotographic copying apparatus according to another embodiment of the present invention.

FIG. 9 shows an example of the latter type. In this copying apparatus 1 of FIG. 9, the original to be copied on the original support 8 is imaged on the photosensitive drum 2 by the scanning optical system 10 comprising mirrors and a lens system. The copying apparatus 1 is equipped with plural cassettes 11A and 11B. A transfer sheet having a desired size is fed out of a selected cassette 11A or 11B by a pick-up roller 12A or 12B. Downstream of the image fixing means 15, there is a deflecting means 45 which can take the solid line position of this Figure so as to direct the sheet downwardly, which is then conveyed again to the feeding roller couple 13 by the conveying belt 47 and the conveying roller couple 48, thus allowing one and the same sheet to receive plural images from the photosensitive member. Otherwise, the deflecting means 40 takes a position wherein it is retracted from the passage of the sheet, whereby the paper is led to the discharging roller couple 46. Further, when the duplex copy, which has images on both sides, is desired, the discharging roller couple 46 is reversed with the trailing edge of the sheet is gripped therebetween so as to switch back the sheet, thus allowing the sheet to receive the image on the second side. When the sheet receives an image on its one side and then is simply discharged, the discharging roller couple 46 continues rotating in the normal direction so as to discharge the sheet onto the tray 16.

In this embodiment, the developing devices 4 and 5 are disposed at a side of the photosensitive drum 2 one above the other along the surface of the photosensitive drum 2. The developing device 4 has a cover 20 which is similar to the cover 20 of the foregoing embodiment, and only the developing device 4 is detachably mountable in the copying apparatus. Unlike the foregoing embodiments, it is not necessary to move the original carriage 8 for the purpose of removing the developing device 4.

In the embodiments described in the foregoing, two developing devices are disposed one above the other along the photosensitive drum which is a image bearing member. Only the upper developing device is detachably mountable in the copying apparatus through the top side of the apparatus. However, it is not always necessary to mount or demount the developing device through an opening in the top wall of the copying apparatus. It is a possible alternative that the developing device is movable in the direction parallel to the axis of the photosensitive drum. The next embodiment is of such a type.

Figure 10:
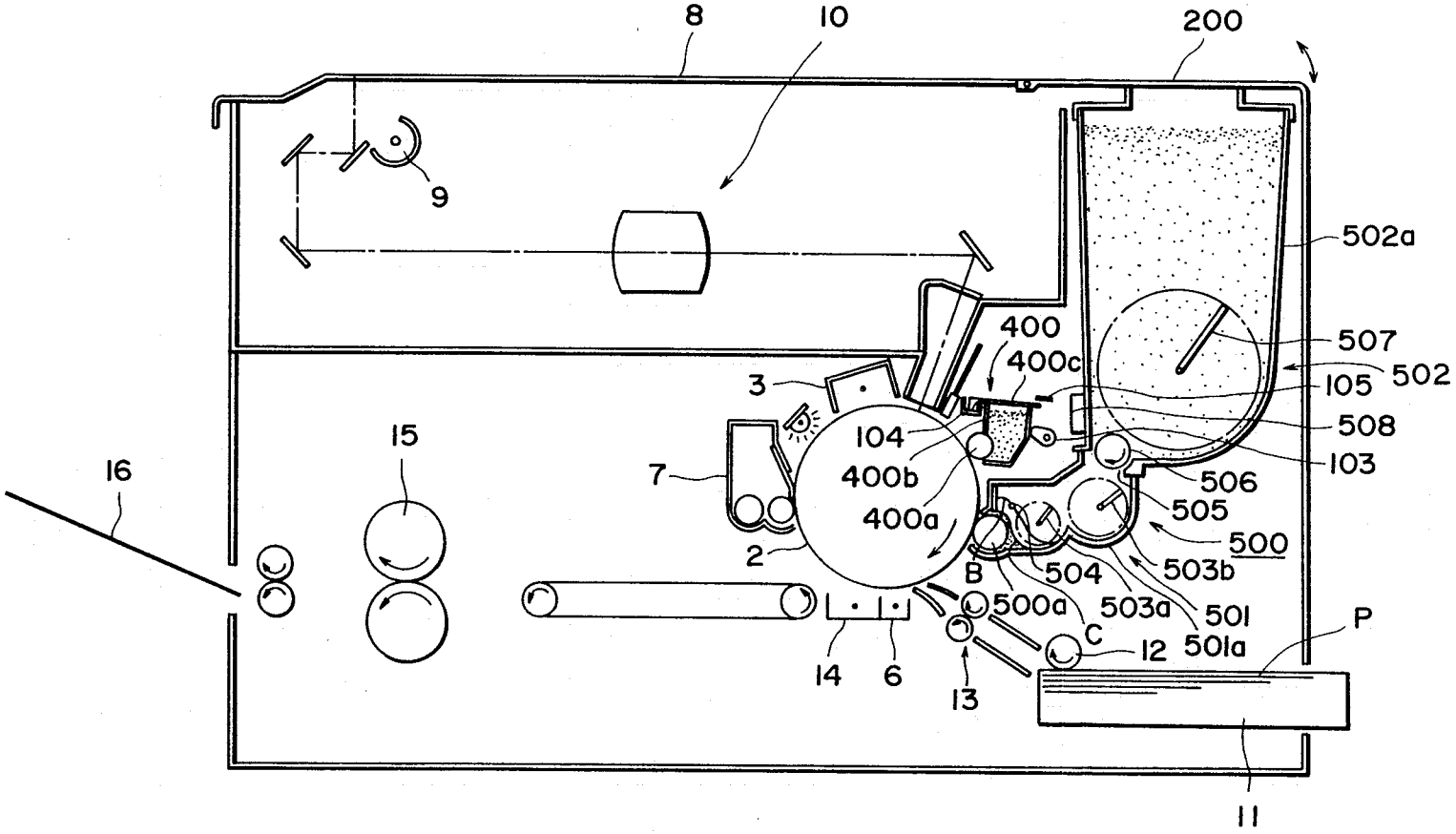
FIG. 10 is a sectional view of an electrophotographic copying apparatus according to a further embodiment of the present invention.

FIG. 10 shows another embodiment o the present invention, wherein a first developing device 400 contains red toner and includes a developer container 400*b*, a developing sleeve 400*a* enclosing a magnet and a cover 400*c* for sealing the developer container 400*b*. A second developing device 500 contains black toner, which includes a developing portion 501 and a toner containing portion 502. The developing portion 501 includes in the container 501*a* a developing sleeve 500*a* enclosing a magnet, a rotatable stirring rods 503*a* and 503*b* arranged parallel to the sleeve 500*a* for stirring the toner and for conveying the toner in the longitudinal direction of the sleeve 500*a* and an antenna member 504 of conductive material coated with insulating material. The upper right of the container 501*a* is provided with an opening 505 which opens toward the toner containing portion 502. In the opening 505, there is a magnet roller 506. The toner containing portion 502 has a container 502*a* in which there is rotatable stirring rods 507.

In operation for taking a copy in black color, when the copying operation starts, the main motor (not shown) rotates, and the photosensitive drum 2 starts rotating. Subsequently, an optical system driving motor (not shown) starts rotating, whereby the optical system 10 starts its scanning operation so as to scan the original placed on the support 8. At this time, the developing sleeve 500*a* of the second developing device 500 starts to rotate through a clutch (not shown) from the main motor. Simultaneously, a developing bias is applied from a high voltage transformer (not shown) to the developing sleeve 500*a*, thus placing the second developing device 500 into operative conditions. Then, the latent image formed on the photosensitive drum 2 in accordance with the original is developed with the black developer. On the other hand, when the second developing device 500 is operating, the developing sleeve 400*a* of the first developing device 400 is not supplied with the developing bias, and the clutch (not shown) is brought into a disengaging state so as not to rotate the sleeve 400*a*.

When, on the contrary, a red copy, for example, is to be taken with the use of the first developing device 400, the clutch (not shown) transmits the driving force to the developing sleeve 400*a* of the first developing device 400, not the second developing device 500, and the developing bias is applied to the developing sleeve 400*a*. By this, the first developing device 400 is placed under operative conditions.

The toner particles in the developing porton 501 of the second developing device 500 are accumulated in the form indicated by a reference B in FIG. 10 by the function of the stirring rods 503*a*. A voltage is induced in the antenna member 504 by the developing bias applied to the developing sleeve 500*a*. When the toner is consumed so that the toner particles are accumulated in the form indicated by a reference C in FIG. 10, the voltage changes since the permittivity across the develop sleeve 500*a* and the antenna member 504. When the voltage changes to a predetermined level, it is detected by a detecting means, in response to which a driving motor (not shown) for the magnet roller 506 is energized. The magnet roller 506 rotates in the direction indicated by an arrow, whereby the toner particles are supplied from the toner containing portion 502 to the developing portion 501. The toner particles supplied t the developing portion 501 are supplied to the developing sleeve 500*a* by the stirring rods 503*a* and 503*b*. When the amount of the toner accumulated around the sleeve 500*a* increases, the induced voltage of the antenna member 504 restores to the original level, whereupon the driving motor (not shown) for the magnet roller 506 is deenergized so that the magnet roller 506 stops. By this, the toner supply from the toner containing portion 502 terminates. In this embodiment, a cover 200 can be opened so as to allow the toner to be supplied into the containing portion 502 from the above when the toner in the containing portion 502 is consumed. In this embodiment, the amount of the toner remaining in the toner containing portion 502 is detected by a detecting element 508 including a piezoelectric element to produce a display or a warning in the operation panel of the copying apparatus so as to inform the operator of the necessity of supplying the toner into the container 502*a*, when the amount of the toner in the container 502*a* decreases down to a predetermined level.

The first developing device 400 of this embodiment is shown as having a cover 400*c* for sealing the container thereof, whereby the toner can not be supplied, that is, the first developing device 400 is of a disposable type. As described hereinbefore, the copying operation with a developer other than the black developer is much less frequently carried out. In view of this, the first developing device 400 does not occupy such a large space as the second developing device 500 in the copying apparatus so that the limited space in the copying machine is efficiently utilized. If desired, the cover 400*c* of the first developing device 400 is made openable so as to allow the first developing device 400 to be supplied with the toner, when the first developing device 400 is removed from the copying apparatus.

Figure 11:
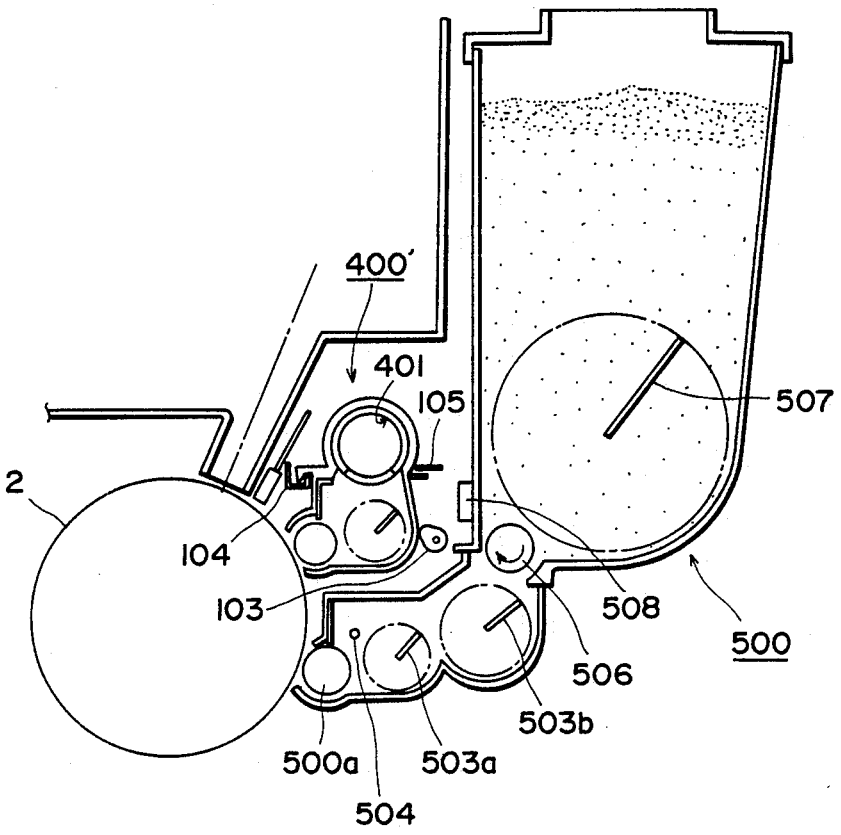
FIG. 11 is a sectional view of a part of a first developing device usable with the copying apparatus of FIG. 10.

FIG. 11 shows another example of the first developing device 400, wherein a cartridge 401 for containing a small amount of the toner is employed. The developing device 400' in this example can be thus supplied with the toner. The cartridgge 401 is retractable from the developing device in a known manner.

The operation of interchanging the first developing device 4 will be described.

Figure 12:
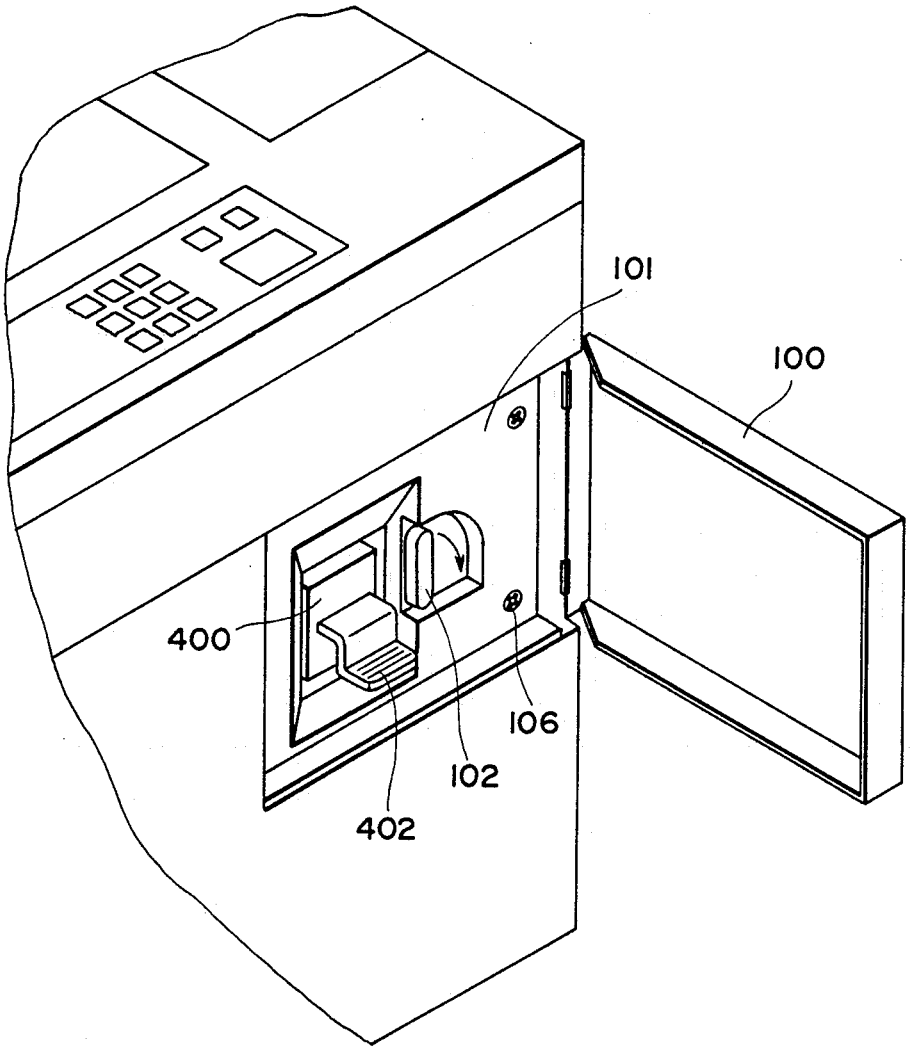
FIG. 12 is a perspective view of a part of the copying apparatus equipped with a small door on the front side thereof which is shown as being opened.

As shown in FIG. 12, the front side of the casing for the copying machine is provided with a small door 100 at a position corresponding to the first developing device 400. When the small door 100 is opened, the operator can see only the first developer 400, but the second developing device 500 is hindered by an internal cover 101 of the copying apparatus so that the operator can not see or access to the second developing device 500. The opening and closing of the small door 100 is detected by an unshown microswitch, so that the image forming operation can not start when the small door 100 is opened in order to avoid any possible damage or danger.

Figure 13:
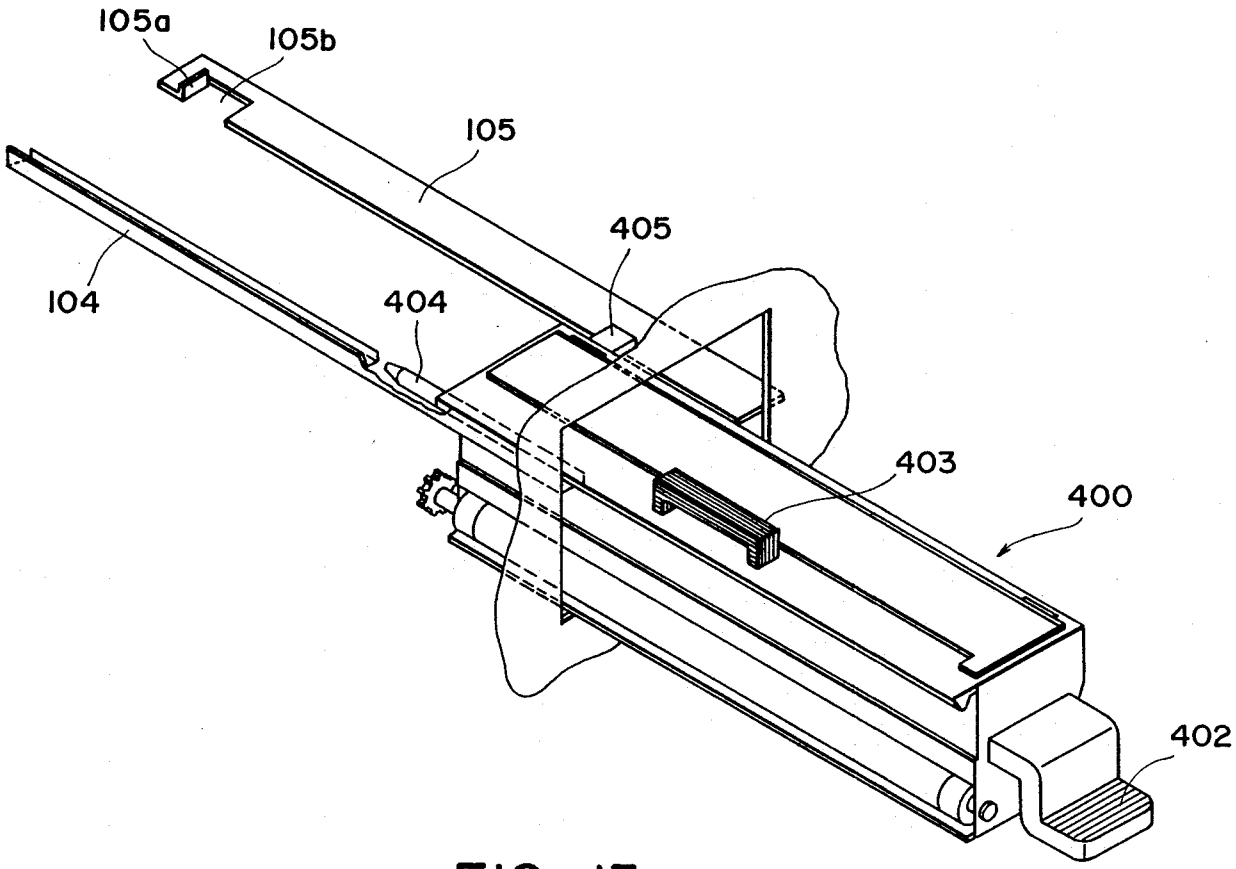
FIG. 13 is a perspective view of the copying apparatus wherein a first developing device is pulled out partway, or it is inserted part-way into the copying apparatus.

When the first developing device 400 is to be retracted from the copying apparatus, the small door 100 is opened, and a manual lever 102 is rotated in the direction of an arrow. By this, the cam 103 operatively connected with the manual lever 102 (FIG. 10) rotates to move the developing device 400 away from the photosensitive drum 2. Then, the first developer 400 is released from the front side limit, so that the developing device 400 can be retracted by pulling a grip 402. When the developing device 400 is retracted part way as shown in FIG. 13, the operator grips a grip 403 provided on the top of the first developing device and pulls up and further retracts it from the copying apparatus. In this embodiment a cover for covering the developing sleeve when the developing device is retracted from the copying apparatus as in the foregoing embodiments may be provided.

When the first developing device 400 is mounted in the copying apparatus, the operator grips the grip 403 and insert the developing device 400 so that a guide pin 404 of the developing device 400 is inserted on the first guide rail 104 of the copying apparatus and that a projection 405 of the developing device 400 at the right-hand side is placed on the second guide rail 105 of the copying apparatus. When the developing device 400 is inserted to a predetermined position, that is, when the leading edge of the projection 405 abuts a stopper 105*a* provided on the second guide rail 105, the projection 405 is engaged with a recess 105*b* formed in the second guide rail 105. In this state, the developing device 400 is swingable toward the photosensitive drum 2. Then, the manual lever 102 is rotated to bring the cam 103 into contact with the back surface of the developer. By this, the developing device 400 is disposed at a predetermined position opposed to the photosensitive drum 2.

In this manner, only the first developing device 400 containing a developer other than the predetermined developer (black in this embodiment) can be easily removed or inserted (or exchanged) by ordinary operators. The second developing device 500 containing the developer of the predetermined color (black in this embodiment) is hindered by an internal cover which is securely fixed to the copying apparatus by screws 106. The internal cover 101 can not be easily removed unless a tool is used. Although, the second developing device 500 can be removed by a service man or the like who uses tools for removing the internal cover 100. The developing device 500 can not otherwise be removed out of the apparatus.

In this Specification, "easily mountable detachable or exchangeable" means that a special work is not required, such as unscrewing, cutting or breaking with a special tool or tools. Usually, the amount of copies taken, and therefore, the consumption of the developer of a color other than the predetermined color (black in this embodiment), is fairly low than those in the predetermined color developer. Therefore, in this embodiment the respective developing devices occupy the corresponding spaces. More particularly in this embodiment, the developer containing capacity of the first developing device 400 is smaller than that of the second developing device 500, and the first developing device 400 as a whole is smaller than that of the second developing device 500. By this, the space taken by the first developing device in the apparatus is reduced to minimum.

On the contrary, the second developing device 500 has a developing portion 501 and the toner containing portion 502, and the second developing device 500 is disposed below the first developing device 400 so that the toner containing portion 502 can be made large. Therefore, the second developing device can have a large toner containig capacity. By doing so, the frequency of the toner supplying operations to the more frequently used developing device can be reduced.

In the foregoing embodiments, the electrophotographic copying apparatus has two developing devices so as to provide two color images in black and red. The present invention, however, is applicable to the case where three or more developing devices are provided in the copying apparatus. In such a case, a most frequently used developing device or more frequently used developing devices of the plural developing devices are fixed so that it or they are not easily retractable from the apparatus, and the other developing device or devices are easily retractable from the apparatus. The predetermined developing device may be for the black and/or another color if desired. By doing so, the image in the color which is frequently used can be obtained at all times without error, while the image in another color can be provided with or without exchanging the additional developing device.

In the embodiments described with respect to FIGS. 10, 11, 12 and 13, the first developing device 400 is disposed upstream with respect to the peripheral movement of the photosensitive drum 2. The developing positions of the first and second developing devices may be exchanged, that is, the first developing device 400 may be disposed downstream of the second developing device 500. However, it is desirable that the first developing device 400 is disposed upstream of the second developing device 500. This is because the more frequently used developing device (the second developing device 5 or 500 in those embodiment) contains a developer which is darker than the developer contained in the first developing device 400. It is possible that the developer of the upstream developing device is conveyed with the peripheral movement of the surface of the photosensitive member 2 to the downstream developing device. If this occurs, the entering of the less dark color developer to the darker developer does not significantly influence the resultant image, but the entering of the darker color toner into the less dark color developer will fairly deteriorates the resultant image, if occurred.

While the invention has been described with reference to the structures disclosed herein, it is not confined to the details set forth and this application is intended to cover such modifications or changes as many come within the purposes of the improvements or the scope of the following claims.

What is claimed is:

1. An image forming apparatus, comprising:

a movable image bearing member;

means for forming a latent image on said image bearing member;

first developing means for developing the latent image formed by said latent image forming means, said first developing means having a capacity for accomodating a first amount of a first developer and being detachably mountable in said image forming apparatus; and second developing means for developing the latent image, said second developing means having a capacity for accomodating a second amount of a second developer different from said first developer, said second developing means being intended for more frequent use than said first developing means and being fixed in said image forming apparatus, and the second amount being larger than the first amount.

2. An apparatus according to claim 1, wherein said first developing means is disposed above the second developing means.

3. An apparatus according to claim 2, wherein said first developing means is above said second developing means, and wherein said first developing means is mountable to or demountable from said image forming apparatus through a top portion thereof.

4. An apparatus according to claim 3, further comprising a chamber for accommodating said first developing means, wherein said first developing means includes a developing roller for supplying the developer to said image bearing member, wherein said chamber has a first opening for allowing mounting and demounting of said first developing means and a second opening for allowing the developing roller of said first developing means to be exposed to said image bearing member, said image forming apparatus further comprising shutter means for opening and closing said first or second opening in response to the mounting and demounting of said first developing means.

5. An apparatus according to claim 1, wherein said supporting means supports said first developing means in a manner that said first developing means is mountable into and detachable from said apparatus in a direction perpendicular to peripheral movement of said image bearing member.

6. An apparatus according to claim 1, wherein said first developing means includes a developing roller for supplying the developer to said image bearing member and a protection cover for protecting said developing roller when said first developing means is detached from said image forming apparatus.

7. An apparatus according to claim 1, wherein said second developing means includes a container having a developing portion provided with a developing roller for supplying the developer to said image bearing member and a developer containing portion for containing the developer to be supplied to said developing portion, means for supplying the developer from said containing portion to said developing portion and means for detecting an amount of the developer remaining in the developing portion, wherein said supplying means is operable in response to said detecting means to supply the developer from said containing portion to said developing portion, wherein said first developing means lacks an automatic developer supplying means responsive to a developer detector.

8. An apparatus according to claim 7, wherein said second developing means further includes means for detecting an amount of the developer remaining in said developer containing portion.

9. An apparatus according to claim 1, wherein said second developer means contains second developer having black toner particles, and said first developing means contains the first developer having non-black toner particles.

10. An apparatus according to claim 9, wherein said first developing means is disposed upstream of said second developing means with respect to peripheral movement of a surface of said image bearing member.

11. An apparatus according to claim 1, further comprising a plurality of first developing means containing developers of different colors, wherein said apparatus further comprises supporting means for supporting any of first developing means containing developers of different colors, respectively.

12. An image forming apparatus, comprising:

a movable image bearing member;

means for forming a latent image on said image bearing member;

first developing means for developing the latent image with a first developer said first developing means being detachably mountable at a predetermined position in said image forming apparatus and being provided with a receiving portion for receiving said first developer to be supplied into said first developing means when said first developing means is taken out of the predetermined position; and second developing means for developing the latent image with a second, different developer said second developing means being fixed in said image forming apparatus.

13. An apparatus according to claim 12, wherein said receiving portion is a top surface.

14. An apparatus according to claim 13, wherein said first developing means includes means for accommodating a cartridge containing the first developer to supply the first developer to said first developing means.

15. An apparatus according to claim 12, wherein said first developing means includes a developing unit containing a developing sleeve, and wherein said developing unit has a receiving portion for toner particles of the first developer to be supplied into said developing unit when said developing unit is taken out of the apparatus.

16. An apparatus according to claim 12, wherein said first and second developers are different in color.

17. An apparatus according to claim 12, wherein said second developing means has a developer containing capacity larger than that of the first developing means.

18. An apparatus according to claim 17, wherein said developing means contains second developer having black toner particles, and said first developing means contains non-black toner particles.

19. An image forming apparatus, comprising:

a movable image bearing member;

means for forming a latent image on said image bearing member;

first developing means for developing the latent image with a first developer, said first developing means being detachably mountable in said image forming apparatus, disposable and lacking an opening for externally supplying the first developer thereinto;

second developing means for developing the latent image with a second developer which is different from the first developer, said second developing means being provided with an opening through which the second developer is supplied thereinto.

20. An apparatus according to claim 19, wherein said second developing means is fixed in the apparatus and has a developer containing capacity which is larger than that of said first developing means, and wherein the second developer contains black toner particles, and the first developer contains non-black toner.

21. An image forming apparatus, comprising:

a movable image bearing member;

means for forming a latent image on said image bearing member;

first developing means for developing the latent image with a first developer, said first developing means including a portion for accommodating a developer replenishing cartridge; and second developing means for developing the latent image with a second developer, said second developing means being fixed in the apparatus and including a developer receiving opening through which the second developer is replenished, wherein said second developing means is provided with a supplying inlet for receiving the second developer from a top side of the apparatus.

22. An apparatus according to claim 21, wherein said first developing means is detachably mountable in said image forming apparatus, wherein said second developing means has a developer containing capacity which is larger than that of said first developing means, and wherein the second developer contains black toner particles, and the first developer contains non-black toner.

* * * * *

UNITED STATES PATENT AND TRADEMARK OFFICE

CERTIFICATE OF CORRECTION

PATENT NO. : 4,916,490

DATED : April 10, 1990

INVENTOR(S) : HIDETOSHI TANAKA ET AL.

It is certified that error appears in the above-identified patent and that said Letters Patent is hereby corrected as shown below:

ON THE TITLE PAGE,

AT [56] REFERENCES CITED

U.S. Patent Documents, insert

| | | | |
|---|---|---|---|
| --3,834,806 | 9-1974 | White et al. | 355/3DD |
| 4,460,267 | 7-1984 | Ogawa | 355/3DD |
| 4,579,443 | 4-1986 | Abuyama et al. | 355/4 |
| 4,583,832 | 4-1986 | Kasamura et al. | 355/3R |
| 4,595,277 | 6-1986 | Maczuszenko et al. | 355/14D--. |

Foreign Patent Documents, insert

| | | | |
|---|---|---|---|
| --56-133744 | 10/1981 | Japan | 355/312 |
| 57-76557 | 5/1982 | Japan | 355/4 |
| 57-104951 | 6/1982 | Japan | 355/4 |
| 59-61860 | 4/1984 | Japan | 355/3DD--. |

COLUMN 4

Line 50, "tone" should read --toner--.

COLUMN 7

Line 8, "foreging example" should read --foregoing example,--
Line 33, "clockwisely" should read --clockwise--.
Line 58, "pulley 00," should read --pulley 70,--.

COLUMN 9

Line 10, "o" should read --of--.
Line 67, "velop sleeve" should read --veloping sleeve--.

UNITED STATES PATENT AND TRADEMARK OFFICE

CERTIFICATE OF CORRECTION

PATENT NO. : 4,916,490

DATED : April 10, 1990

INVENTOR(S) : HIDETOSHI TANAKA ET AL.

It is certified that error appears in the above-identified patent and that said Letters Patent is hereby corrected as shown below:

COLUMN 10

Line 7, "t the" should read --to the--.

COLUMN 11

Line 15, "insert" should read --inserts--.
Line 51, "low" should read --lower--.

COLUMN 12

Line 42, "deteriorates" should read --deteriorate--.
Line 57, "accomodating" should read --accommodating--.
Line 62, "accomodating" should read --accommodating--.

COLUMN 13

Line 54, "second developer means" should read --second developing means--.

UNITED STATES PATENT AND TRADEMARK OFFICE

CERTIFICATE OF CORRECTION

PATENT NO. : 4,916,490

DATED : April 10, 1990

INVENTOR(S) : HIDETOSHI TANAKA ET AL.

It is certified that error appears in the above-identified patent and that said Letters Patent is hereby corrected as shown below:

COLUMN 14

Line 5, "developer said" should read --developer, said--.
Line 14, "developer said" should read --developer, said--.
Line 35, "developing means" should read --second developing means--.
Line 47, "thereinto;" should read --thereinto; and--.

Signed and Sealed this

Sixth Day of October, 1992

*Attest:*

DOUGLAS B. COMER

*Attesting Officer*

*Acting Commissioner of Patents and Trademarks*